US005831643A

United States Patent [19]

Chung

[11] Patent Number: 5,831,643

[45] Date of Patent: Nov. 3, 1998

[54] WRITE HEAD CONTROL DEVICE FOR INK JET PRINTER UTILIZING LIQUID METAL AND METHOD THEREOF

[75] Inventor: Kwang-Young Chung, Suwon, Rep. of Korea

[73] Assignee: SamSung Electronics Co., Ltd., Suwon, Rep. of Korea

[21] Appl. No.: 639,091

[22] Filed: Apr. 24, 1996

[30] Foreign Application Priority Data

Apr. 24, 1995 [KR] Rep. of Korea ..... 1995 9586

[51] Int. Cl.[6] ..... B41J 29/38; B41J 2/06

[52] U.S. Cl. ..... 347/17; 347/55

[58] Field of Search ..... 347/17, 55, 60, 347/21, 51, 54

[56] References Cited

U.S. PATENT DOCUMENTS

| | | | |
|---|---|---|---|
| 4,845,517 | 7/1989 | Temple et al. . | |
| 5,182,578 | 1/1993 | Goepel et al. . | |
| 5,560,543 | 10/1996 | Smith et al. | 239/102.2 |
| 5,598,200 | 1/1997 | Gore | 347/88 |

*Primary Examiner*—N. Le
*Assistant Examiner*—Thinh Nguyen
*Attorney, Agent, or Firm*—Robert E. Bushnell, Esq.

[57] ABSTRACT

To maintain a temperature of a liquid metal mass utilized in a write head for an ink jet printer, an improved control device is disclosed which comprises a heating element and a temperature sensor element. In the disclosure, there is provided a write hood device in an ink printer equipment having at least an ink storage chamber inside body of the head, a nozzle for ejecting an ink droplet at one portion of the chamber, an ink channel formed to connect the chamber and an ink cartridge, a pair of electrodes provided at another portion of the chamber and each disposed opposite to each other for charging a liquid metal mass with electricity, a pair of magnetic substances symmetrically disposed to face each other and disposedly arranged at an angle of 90°; with respect to the magnetic substances, wherein said liquid metal mass movably contained at the bottom of the chamber for purging ink to discharge an ink, droplet, said write head comprising; a temperature sensor element for sensing a temperature at a predetermined portion of said write head: and a heating element provided at a predetermined location of said write head, for maintaining the temperature of said liquid metal at a level beyond a prescribed degree by way of directly warming said ink, whereby the temperature of said liquid metal holds a degree of substantially constant level beyond a melting point. As a result, a liquid metal holds the temperature at a substantially constant value during a normal mode of operation, maintaining its phase in liquid state, thereby enhancing the performance of the printer.

13 Claims, 5 Drawing Sheets

WRITE HEAD CONTROL DEVICE FOR INK JET PRINTER UTILIZING LIQUID METAL AND METHOD THEREOF

CROSS-REFERENCE TO RELATED APPLICATION

This application makes reference to, incorporates the same herein, and claims all benefits accruing under 35 U.S.C.§119 from an application for *Printing Head Control Apparatus For Ink Jet Printer Utilizing Liquid Metal And Method Thereof* earlier filed in the Korean Industrial Property on the 25th of Apr. 1995 and assigned Ser. No. 9686/1995 by that Office.

BACKGROUND OF THE INVENTION

The present invention relates to a write head of an ink jet printer, and more particularly, to a write head control device and process using a liquid metal for ejecting individual ink droplets in liquid state during an operational mode of the printer.

Typically, an ink storage chamber is provided inside the body of a write head in a conventional ink printer, and a nozzle ejects individual ink droplets. The ejection of individual ink droplets from the tip of the nozzle in the write head is subject to the influence of the Lorentz force equation. Thus the magnitude of a force applied to an ink droplet in the path of magnetic line of force is determined by Fleming's left-hand rule. The influence of the electric resistance of the ink is extremely critical for each droplet ejection. I have found that although electric resistance ought to be lower than five Ohms, in actuality this low a resistance is unattainable.

The use of a either a diaphragm or of liquid metal to eject droplets of ink has also been proposed. The Droplet Deposition Device proposed by Stephen Temple et al., in U.S. Pat. No. 4,845,517 suggests a write head for an ink jet printer employing a liquid metal as a propagative actuator for applying a force. In this proposal, ink is forced to be discharged at the tip of nozzle by virtue of a applied kinetic energy generated by an operation of the Lorentz force equation via liquid metal so that an operation of printing is enabled. Liquid metal is known to have to hold its temperature at not less than a constant value, e.g., 18° C. so as to remain in a liquid state. As a result, the normal operation of portraying characters and graphics on a recording medium is highly dependent upon the temperature of liquid metal since below a melting point temperature the liquid metal assumes the properties of solid state, a fact that I have found often hinders the normal operational mode of an ink jet printer.

SUMMARY OF THE INVENTION

Therefore it is an object of the present invention to provide an improved write head controller for an ink jet printer.

It is another object to provide a write head control device for an ink jet printer utilizing a liquid metal, for controlling a heating element to hold the temperature of the liquid metal at a constant value above a melting point during an operational mode of a printer.

It is another object to provide a controlling method with an ink jet printer for controlling the temperature of a liquid metal to maintain a constant value above a melting point so that a liquid metal remains in a liquid state during an operational mode of a printer.

To achieve these and other objects, there is provided a write head in an ink jet printer including a plurality of ink storage chamber inside the body of a write head; a nozzle for ejecting an ink droplet on the top portion of an ink storage chamber; a plurality of ink channels for flowing an ink supplied from an ink tank; and a pair of electrodes and a pair of magnetic substances, symmetrically opposed to each other and each electrodes arranged to be disposed at an angle of 90 degrees with respect to magnetic substances, surrounding the periphery of the lower portion of the ink storage chamber, which head comprises a temperature sensor for sensing a temperature of a predetermined portion of the write head and a heating device arranged on the write head so as to maintain the temperature of a liquid metal at or above a predetermined constant value by warming ink.

There is also provided a method for controlling that utilizes a write head in an ink jet printer the steps of sensing a temperature of a predetermined portion of a write head to detect a temperature of a liquid metal, determining whether the detected temperature is below a preset value, driving a heating device when the detected temperature falls under a preset value, and turning off an operation of a heating device when the detected temperature value is beyond a preset value.

BRIEF DESCRIPTION OF THE DRAWINGS

A more complete appreciation of the invention, and many of the attendant advantages thereof, will be apparent as the same becomes better understood by reference to the following detailed description when considered in conjunction with the accompanying drawings in which like reference numerals and symbols indicate the some or similar components, wherein.

Figure 5:
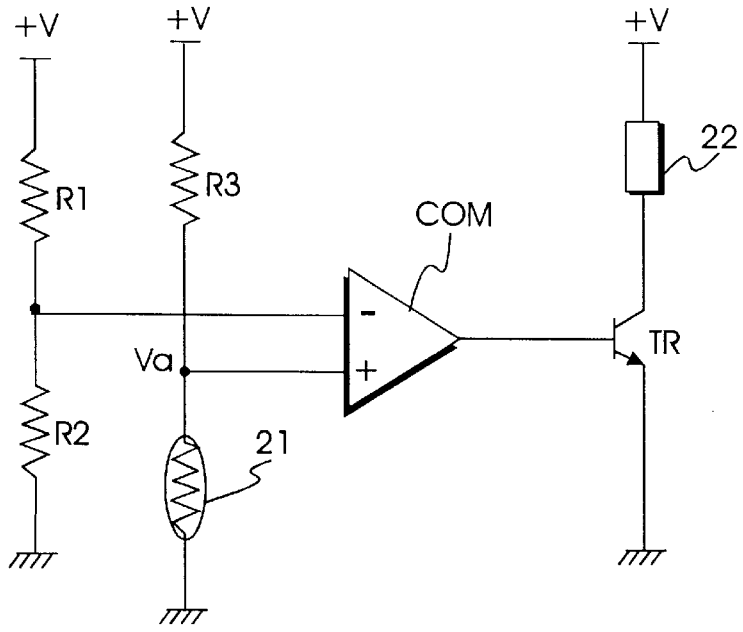
Figure 6:
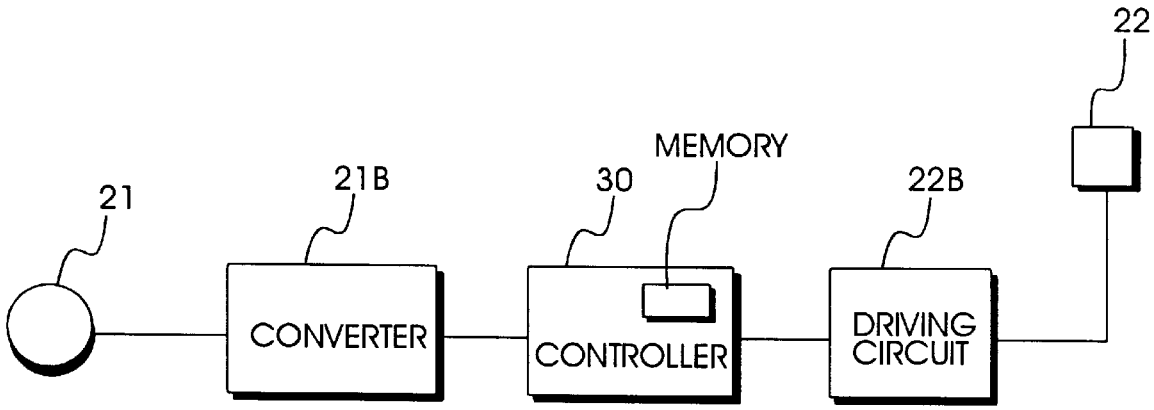
Figure 7:
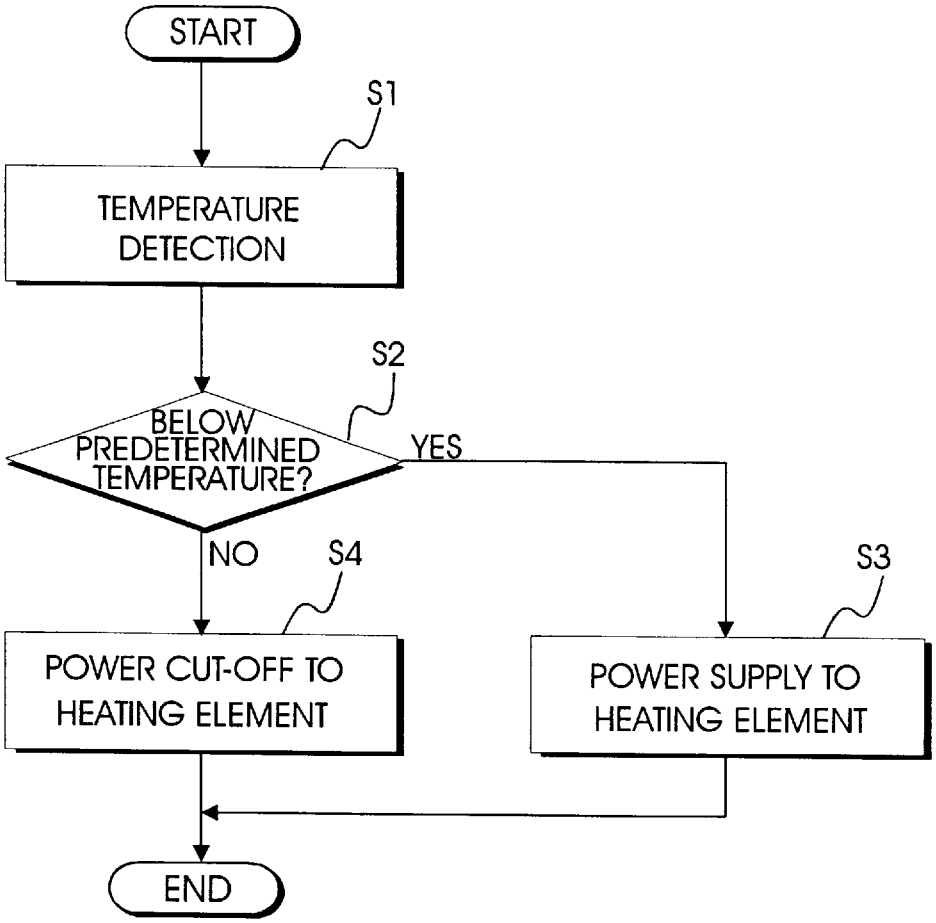

Fig, 4 is a schematic sectional view of another preferred embodiment of a write head control device constructed according to the principle of the present invention;

FIG. 5 is a schematic circuit diagram of a driving circuit of one preferred embodiment constructed according to the principle of the present invention;

FIG. 6 is a block diagram illustrating a portion of circuitry of an ink jet printer incorporating the driving circuit of FIG. 6; and FIG. 7 is a flow chart illustrating a sequential order of controlling operation of a circuit as shown in FIG. 6.

DETAILED DESCRIPTION OF THE PREFERRED EMBODIMENT

A known principle in an ink printer for portraying characters on a recording medium is based upon ejection of individual ink droplets from the nozzle of a write head that is a component part of the printer. The ink drops are usually ejected from the nozzle under the influence of a controller in an ink printer. Characters and graphic patterns are typically constructed with a grid-like pattern on the recording medium by coordinating the ejection of individual droplets and the relative motion between the recording medium and the write head. The operational reliability and the quality of the recording are highly dependent on the uniformity of the droplet ejection, i.e., the individual droplets ejected by 2 drive pulse must leave the nozzle of the write head with the respectively same speed.

Conventionally, the controller in a bubble jet printer provides a write head with a heating device able to suddenly heat the ink in the region of an ink channel so as to induce an osmotic action of the ink until an ink vapor bubble is formed. Bubbling of ink by the heating device causes ejection of ink from a nozzle of a head write in the printer. A heating device of the type describe above serves as a heating element for warming the ink.

It is known, as evidenced by the *Heating Mechanism For Warming The Ink In The Write Head Of An Ink Printer Means* in U.S. Pat. No. 5,182,578 to Ernst-Goepel et al. to provide a heating device for warming ink in an ink channel arranged in a write head of an ink jet printer. The heating device includes a heating element and a temperature sensor arranged on a write to head carrier as well as a voltage regulator. The heating element above disclosed is supplied with a constant load current via a regulating circuit until an adjustable operating temperature is reached. The heating energy for warming the ink is offered via the dissipated heat of the heating element. In the device of Ernst-Goepel '578, the ink in the type of an ink jet printer is warmed by a heating device equipped with a temperature sensor element and a voltage regulator with a heating element being arranged on the write head carrier.

Due to the frequency of times for warming ink with the heating element, the innate characteristics of an ink become worse. This degradation causes the expected life span of a write head as well as the heating element itself to be short. As a result, a controller constructed with a temperature sensor element and a heating element serving as a heating device for warming the ink and for controlling the temperature of the ink, does not guarantee reliable regulation of the temperature.

Figure 1A:
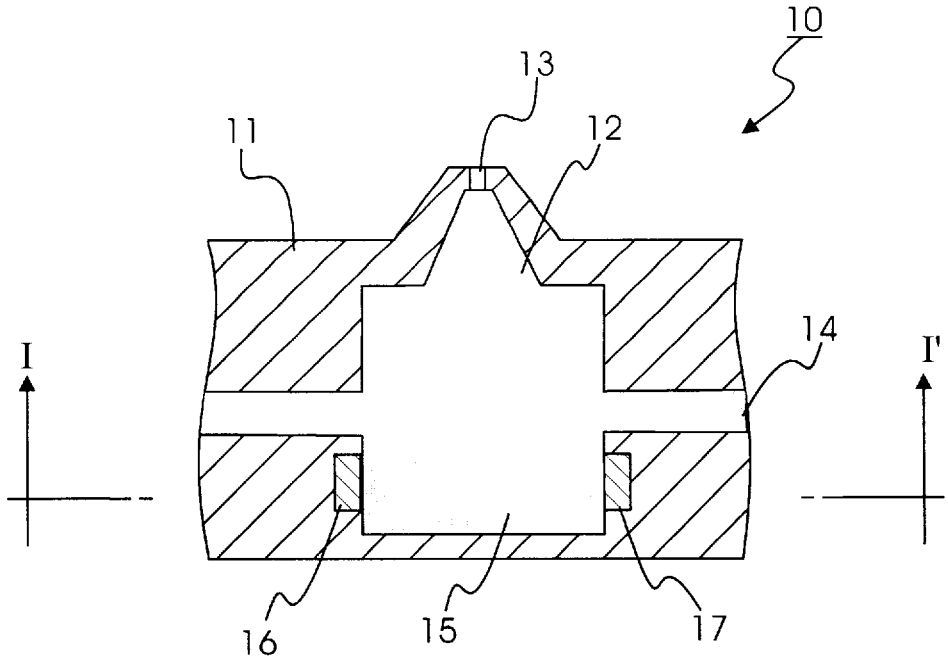
Fig. 1A is a schematic sectional view illustrating a conventionally constructed configuration of a write head in an ink jet printer employing a sole ink storage chamber.
Figure 1B:
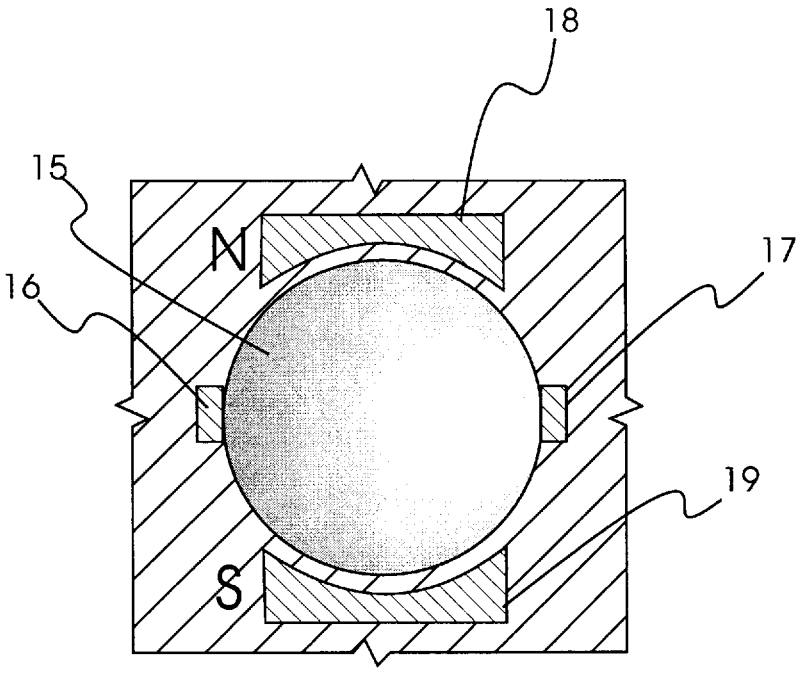
Fig. 1B is an enlarged sectional view of the write head, taken along the line I–I' in FIG. 1A.

Referring now to FIGS. 1A and 1B, a detailed explanation for the conventionally employed scheme has an ink storage chamber 12 provided inside body 11 of a write head 10 in a conventional ink jet printer. A nozzle 13 which ejects an individual ink droplets, is provided at the substantially centered area of top surface of ink storage chamber. A couple of ink channels 14 are arranged opposite from each other for supplying an ink from an outside ink tank (not shown) to the inside of ink storage chamber 12.

A pair of electrodes 16, 17 and a pair of magnetic poles having respective N and S polarities as shown are arranged perpendicularly to each other around the periphery of the lower portion of ink storage chamber 15, so that each of the electrodes is disposed symmetrically and arranged at an angle of ninety degrees relative to each of the magnetic poles.

The behavior of individual ink droplets during ejection from the tip of nozzle 13 in write head 10 is subject to the influence of the Lorentz force equation. Thus, the magnitude of a force applied to an ink within the path of the magnetic lines of force occurring between a pair of magnetic poles 18, 19 is determined by Fleming's left-hand rule. Ink is forced to move commonly perpendicularly to the directions of both magnetic flux and current. As a result, each individual ink droplet is discharged via the ink channel in nozzle 13 by virtue of a combined force derived from the magnetic field formed between magnetic poles 18 and 19 in combination with an electric field formed between pair of electrodes 16 and 17 while supplied with a constant current. The influence of the electric resistance of ink 15 utilized in the construction of such write head mechanism is extremely critical for individual droplet ejection. The electric resistance should be lower than 5 Ohms (Ω), a condition that I have found to be unattainable in actuality.

There has been a proposal to employ a diaphragm, for example, such as a piezoelectric material, so that ink 15 is forced indirectly by the diaphragm liquid metal has recently been proposed in lieu of the above diaphragm. U.S. Pat. No. 4,845,517 to Temple et al, for example, suggests a write head for an ink jet printer employing a liquid metal as a propagative actuator for forcing the ink to travel.

Figure 2A:
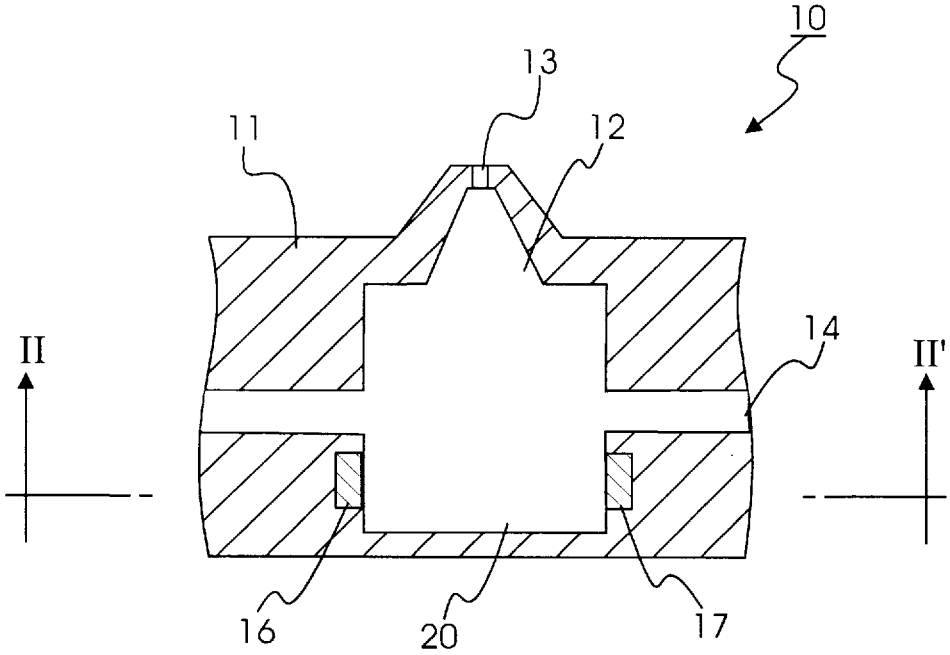
FIG. 2A is a schematic-sectional view of a conventionally adopted configuration of a write head in an ink jet printer utilizing a liquid metal.
Figure 2B:
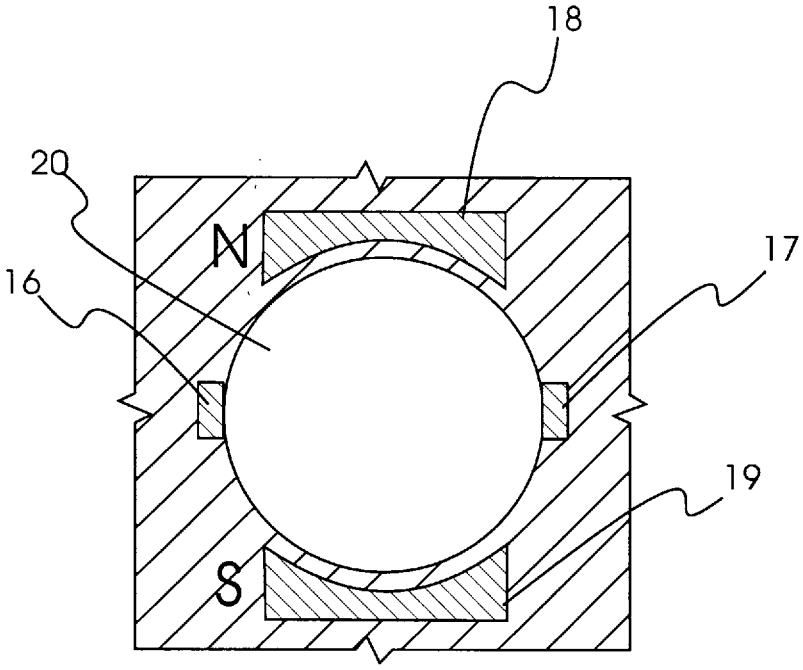
FIG. 2B is an enlarged sectional view of the write head, taken along the line II–II' in FIG. 2B.

FIGS. 2A and 2B illustrate respective sectional views of a write head where liquid metal 20 is utilized in the write head 10 of a ink jet printer.

In the configuration disclosed in the conventional technique, liquid metal 20 is supplied to ink storage chamber 12 in a predetermined amount of quantity. Liquid metal can be a compound of indium (In) and gallium (Ga), and would also meet the requirement for electric resistance of less then five ohms, which is unattainable with the innate property of an ink. Accordingly, liquid metal serves as an actuator of kinetic energy in lieu of the mass of the ink. Therefore, ink 15 is forced to be discharged at the tip of nozzle 13 by virtue of an applied kinetic energy generated by an operation of the Lorentz force equation via liquid metal so that the operation of printing is enabled. Liquid metal served as above is known to hold the temperature of itself at not less than a constant value, e.g., 18° C., so as to remain in a liquid state. I have found that as a result, a normal printing operation of portraying characters and graphics on a recording medium 13 highly dependent on the temperature of liquid metal since below a melting point temperature, the liquid metal maintains its properties of solid state. Consequently, I have noticed that these drawbacks often hinder the normal operational mode of an ink jet printer.

Figure 3:
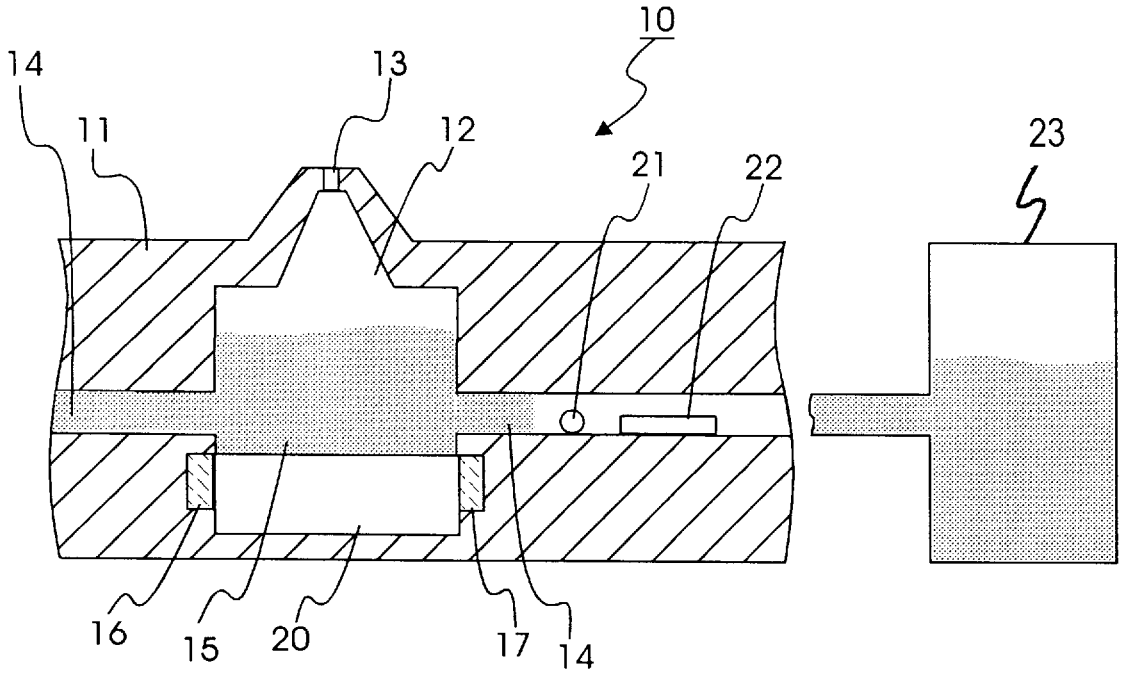
FIG. 3 is a schematic sectional view of one preferred embodiment of a write head control device constructed according to the principle of the present invention.

Referring now to FIG. 3 in conjunction with FIGS. 1B and 2B, there is illustrated one preferred embodiment of a write head control device of the present invention. A plurality of ink storage chambers 12 are provided inside body 11 of a write head 10; the chambers of write head 10 are arranged either separately or collectively linked to each other by respective ink channel 14 in construction. Write head 10 may be constructed in a configuration having a plurality of linked ink channels, either with a single ink storage chamber providing mass storage capability or with several isolated ink storage chambers that would be available as necessary. A nozzle 13 is provided at a portion of an ink storage chamber 12, preferably at the top portion thereof, through which an ink droplet is ejected for printing during a printing mode operation. An ink storage chamber is supplied with ink from an ink cartridge 23 via ink channel 14.

At least one ink channel 14 is connected to an ink cartridge 23 for supplying ink to head 10. A pair of electrodes 16 and 17 are oppositely provided in body 11 while a pair of magnetic poles 18 and 19 are arranged at a right angle between each electrode as described in the discussion of FIGS. 1A and 2B. Also, a mass of liquid metal 20 is provided at the bottom of chamber 12.

As can be seen in the drawings, a location opposite from nozzle 13 does not necessarily refer to a position that is face to face to nozzle 13. Any position will rather do if ejection of ink is performed by actuating operation of liquid metal.

According to the present invention, a temperature sensor 21 for indirectly detecting the temperature of the liquid metal mass 20 and a heating element 22 for indirectly heating the liquid metal mass 20 are provided at, and preferably within, an ink channel 14. Heating element 22 heats ink and thus liquid metal mass 20 is indirectly heated by warm ink 15 within chamber 12.

According to the principles of the present invention temperature sensor 21 and heating device 22 may well be embodied in a write head 10 on every nozzle 13, or alternately singly or collectively installed to service groups of blocks as necessary. Heating element 22 heats ink 15 and indirectly warms liquid metal 20, and may be positioned any place within body 11, thereby enabling direct heating of liquid metal 20. Any location may be chosen for heating device 22, for instance, any surface area of write head 10, inside ink channel 14, any sidewall of inside ink storage chamber 12 for containing ink or liquid metal, and inside body 11. Additionally, and referring now to FIG. 4, temperature sensor 21A may be disposed in a location adjacent to liquid metal 20 so as to directly sense the temperature thereof Thus, any location at which the temperature of liquid metal 20 be sensed whether directly or indirectly, may be chosen for temperature sensor 21A; for example, within body 11, within the inner sidewalls adjacent to either storage portion of ink or liquid metal in ink storage chamber 12, ink channel 14 and on any surface portion of head 10.

Figure 4:
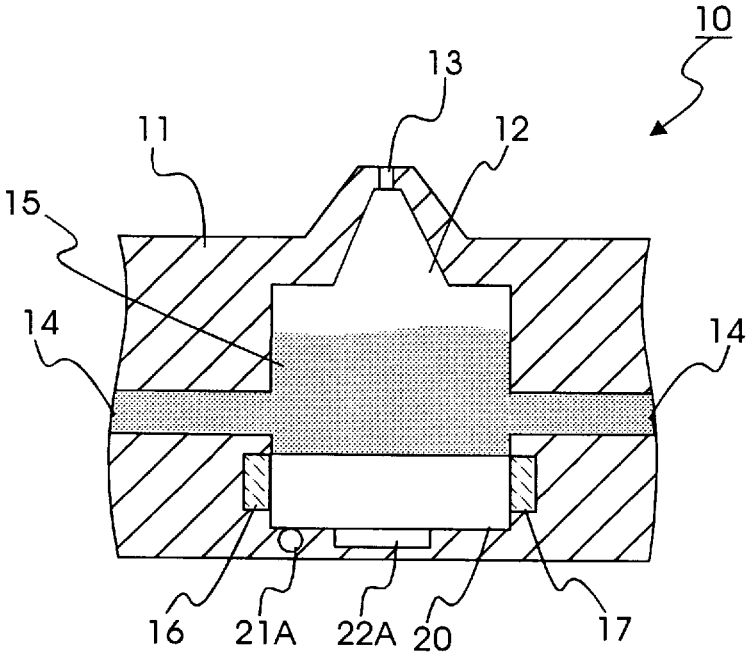

The electrodes 16 and 17 and magnetic segments 18 and 19 in FIGS. 3 and 4 are controlled by a control circuit shown in FIG. 5. The control circuit includes a first voltage divider having two fixed resistor R1 and R2, and second voltage divider having a fixed resistor R3 and a temperature sensor 21 as an variable resistor. A comparator COM having inverting and non-inverting input ports and a transistor TR connected to an output of the comparator COM for turning on or off heating element 22. Predetermined reference voltage Vref, which is voltage divided by first voltage divider, a pair of resistors R1 and R2, connected in series to a local reference potential such as a ground potential, is applied to a non-inverting terminal (−) of comparator COM. A potential Va at a varying voltage level is generated by second voltage divider, at the junction of resistor R3 and temperature sensor 21, is applied to an inverting terminal (+) of comparator COM. Temperature sensor 21, 21A is coupled between the non-inverting terminal (+) of comparator COM and the local reference potential.

Output terminal of comparator COM is connected to the base electrode of transistor TR whose emitter electrode is coupled to the local reference potential and collector electrode is connected to power source +V via heating element 22. Preferably, temperature sensor 21 is a type of a negative temperature coefficient device and has an internal resistance which is adapted to be correspondingly increased as the detected temperature is higher than a pre-established temperature which is preferably in a range extending from about 18° C. to about 23° C.

When the sensor 21 detects a temperature lower than about 18° C. which is a melting point of the liquid metal, the voltage Va of the second voltage divider becomes higher than the reference voltage (Vref) because of the increased resistance of the sensor 21. Thus the voltage (Va) is supplied to comparator COM and then comparator COM outputs a high level signal to transistor TR to the thereby turn on the heating element 22.

When the temperature detected by sensor 21 is higher than the pre-established temperature, the internal resistance of the sensor 21 is lowered and the voltage (Va) of the second voltage divider is lower than the reference voltage (Vref) of the first voltage divider, then comparator COM outputs a low level signal to transistor TR to thereby turn off the heating element 22. Accordingly, the liquid metal can be maintained in a liquid phase. Here, a predetermined temperature is preferably in the range of about 0°–5° C. higher than a melting point. As a result, if transistor TR is turned on (i.e., if the principal electrically conducting channel between the collector and emitter electrodes is biased at its base control electrode into an electrically conducting state), then heating element 22 dissipates heats, and the temperature of liquid metal 20 becomes in turn higher as the temperature of the ink gets higher.

When the temperature of liquid metal 20 exceeds a predetermined value, then a potential Va becomes lower following the decreased internal resistance of temperature sensor 21, thereby enabling comparator COM to generate a signal of low level, which in turn cuts off the principal electrical conduction path in transistor TR between its collector and emitter electrodes. At this moment, heating element 22 cease a heat dissipation. With the above operation described, the temperature of liquid metal 20 is maintained at a constant level.

FIGS. 6 is a block diagram of a circuit for controlling the heating of the mass liquid metal by a sequential operation of software stored in a microprocessor of a printer. The circuit as shown in FIG. 6 incorporates temperature sensor 21 for sensing the temperature of ink 15, converter 21B for converting an amount of varying resistance of temperature sensor 21 into a voltage of constant level, controller 30 for controlling overall operation of the circuitry in a printer, a memory device 31, for supplying a prestored data to controller, which device available internally or externally by way of a circuit configuration design, driving circuit 22B for driving heating element 22, and heating element 22.

Referring to FIG. 7, a flow chart demonstrating a sequential order of operation of the circuit of FIG. 6 is illustrated. Firstly, a predetermined program is stored in memory device 31. When the circuit is energized then the program is read to be executed in controller 30. Temperature sensor 21 senses a temperature on a scale of temperatures, and applies the value of the temperature sensed to convener 21B. A signal converted in converter 21B on the basis the value of the temperature sensed is fed to controller 30. (Step S1). Controller determines whether the input signal applied from converter 21B indicative of the temperature of liquid metal 20, is lower than a predetermined temperature which is preset at a relevant addresses in memory in step S2.

When it is determined that the input signal represents a degree of temperature below a preset value, then controller 30 outputs a signal to driving circuit 22B so as to initiate a heat dissipation operation of heating element 22 in Step S3.

In Step S2 however, if the input signal is determined to indicate a value higher than a preset reference value, then controller 30 outputs no signal and heating element 22 ceases heat dissipation in Step S4.

Sequential operations performed as above enable liquid metal to hold its temperature at a constant value, without loss that would drop the temperature of liquid metal twenty below the critical melting point temperature.

As disclosed above, the instant invention embodied in various types of preferred embodiments holds the temperature of liquid metal at or above the melting point temperature of the composition of liquid phase metal utilized, thereby enabling an operational temperature of a write head to be properly maintained, thus enhancing overall performance of an ink jet printer.

While there have been illustrated and described what is to be considered the preferred embodiment of the present invention, It will be understood by those skilled in the art that various changes and modifications may be made, and equivalents may be substituted for elements thereof without departing from the true scope of the present invention. In addition, many modifications may be made to adapt a particular situation to the teaching of the present Invention without departing from the scope thereof. Therefore, it is understood that the present invention is not limited to the particular embodiments disclosed as the beat mode contemplated for carrying out the present invention, but embodiments falling within the scope of the appended claims.

What is claimed is:

1. A write head device for an ink printer using an ink cartridge, comprising:

an ink storage chamber;

nozzle for ejecting an ink droplet disposed at one portion of said chamber;

an ink channel formed to connect said chamber and the ink cartridge;

a pair of electrodes provided at another portion of the chamber dispose opposite to each other for charging a mass of liquid metal within said chamber with electricity;

a pair of magnetic poles symmetrically disposed to face each other on opposite sides of said chamber in an orthogonal arrangement with said pair of electrodes, said liquid metal mass being movably contained at a bottom of said chamber for purging ink to discharge in droplets through said nozzle;

a temperature sensor element for sensing a temperature at a predetermined location of said write head; and a heating element provided at a another location of said write head, for operatively responding to signals provided by said temperature sensor representative of said temperature at said predetermined location by maintaining the temperature of said liquid metal at a level beyond a prescribed degree by directly warming said ink, and maintaining said liquid metal at a temperature exhibiting a substantially constant level above a melting point of said liquid metal.

2. The write head device of claim 1, further comprised of a unit of several blocks of individual nozzles, with at least a pair of said temperature sensor element and heating element being employed in said write head commonly shared by said unit of several blocks.

3. The write head device in an ink printer equipment as claimed in claim 1, wherein said temperature sensor element is incorporated any location of said write head.

4. The write head device in an ink printer equipment as claimed in claim 1, further comprised of said temperature sensor element being provided at a location substantially adjacent to an ink storage portion of said chamber.

5. The write head device in an ink printer equipment as claimed in claim 1, further comprised of said temperature sensor element being provided at a location substantially adjacent to an liquid metal storage portion of said chamber.

6. The write head device in an ink printer equipment as claimed in claim 1, further comprised of said temperature sensor element being provided at inner surface of said ink channel.

7. The write head device in an ink printer equipment as claimed in claim 1, further comprised of said heating element being positioned at a prescribed location on a surface area of said write head.

8. The write head device in an ink printer equipment art claimed in claim 1, further comprised of said heating element being provided at a prescribed location of said chamber.

9. The write head device in an ink printer equipment as claimed in claim 1, further comprised of said heating element being provided at a location substantially adjacent to an ink storage portion of said chamber.

10. The write head device in an ink printer equipment as claimed in claim 1, further comprised of said heating element being provided at a location substantially adjacent to a liquid metal storage portion of said chamber.

11. The write head device in an ink printer equipment as claimed in claim 1, further comprised of said heating element being provided at an inner surface of said ink channel.

12. The write head device for an ink printer of claim 1, with said temperature sensor element and heating elements further comprising a circuit comprised of:

a first pair of voltage dividing resistors connected in series, for supplying a reference voltage at a constant level from a junction node;

a second pair of voltage dividing resistors comprising a resistor and said temperature sensor element, connected in series for supplying varying voltage;

a comparator comparing said reference voltage with said varying voltage to output a signal at an output terminal of said comparator; and a transistor having a control electrode coupled to said output terminal of said comparator, an emitter electrode coupled to a reference potential and a collector electrode coupled to a power source via said heating element.

13. A method for controlling a write head in an ink printer equipment utilizing a liquid metal mass, said method comprising the steps of:

sensing a temperature at a predetermined location on said write head to detect the temperature of said liquid metal; determining whether said detected temperature falls below a preset value;

driving a heating element when the detected temperature is below said preset value; and turning off an operation of said heating element when the detected temperature is beyond said preset.

* * * * *